US010435947B2

(12) United States Patent
Parker et al.

(10) Patent No.: US 10,435,947 B2
(45) Date of Patent: Oct. 8, 2019

(54) LADDER WITH PINCH FLEX LATCH, AND METHOD

(71) Applicants: Thomas W. Parker, Jamestown, PA (US); Tek Lentine, Cary, IL (US)

(72) Inventors: Thomas W. Parker, Jamestown, PA (US); Tek Lentine, Cary, IL (US)

(73) Assignee: Werner Co., Greenville, PA (US)

( * ) Notice: Subject to any disclaimer, the term of this patent is extended or adjusted under 35 U.S.C. 154(b) by 67 days.

(21) Appl. No.: 15/802,949

(22) Filed: Nov. 3, 2017

(65) Prior Publication Data

US 2018/0163467 A1 Jun. 14, 2018

Related U.S. Application Data

(63) Continuation-in-part of application No. 15/375,996, filed on Dec. 12, 2016, now abandoned.

(60) Provisional application No. 62/520,965, filed on Jun. 16, 2017.

(51) Int. Cl.

| | |
|---|---|
| ***E06C 7/06*** | (2006.01) |
| ***E06C 1/383*** | (2006.01) |
| ***E06C 1/18*** | (2006.01) |
| ***E06C 7/50*** | (2006.01) |
| ***E06C 1/16*** | (2006.01) |
| ***E06C 7/14*** | (2006.01) |
| ***E06C 1/04*** | (2006.01) |
| ***E06C 1/14*** | (2006.01) |

(52) U.S. Cl.

CPC ..... *E06C 1/383* (2013.01); *E06C 1/04* (2013.01); *E06C 1/14* (2013.01); *E06C 1/16* (2013.01); *E06C 1/18* (2013.01); *E06C 7/06* (2013.01); *E06C 7/14* (2013.01); *E06C 7/50* (2013.01)

(58) Field of Classification Search

CPC ..... E06C 1/14; E06C 1/16; E06C 1/18; E06C 1/20; E06C 1/383; E06C 7/00; E06C 7/06; E06C 7/50

See application file for complete search history.

(56) References Cited

U.S. PATENT DOCUMENTS 3,565,211 A * 2/1971 Le Blanc ..... E06C 1/12 182/211
4,527,821 A * 7/1985 Tanaka ..... E05C 19/06 24/297
4,832,384 A * 5/1989 Venable ..... E05C 19/06 292/87
4,881,764 A * 11/1989 Takahashi ..... E05C 19/066 292/13
5,123,681 A * 6/1992 Kos ..... E05C 19/06 206/710
5,704,662 A * 1/1998 Kwiatkowski ..... E05B 17/2023 292/194

(Continued)

*Primary Examiner* — Colleen M Chavchavadze
(74) *Attorney, Agent, or Firm* — Ansel M. Schwartz

(57) ABSTRACT

A ladder having a front section and a rear section. The ladder has a step attached to the front section and a cross bar attached to the rear section. The ladder has a latch attached to the cross bar and positioned on the cross bar so when the ladder is in a folded position where the front section is alongside and in parallel with the rear section, the latch latches with the step. The latch has a hook portion having a hook which engages with the step that the latch holds in place. The latch has a base portion that is fixed to the cross bar. The latch has a pinch flex portion connected to the base portion and the hook portion.

5 Claims, 15 Drawing Sheets

(56) References Cited

U.S. PATENT DOCUMENTS

| | | | | |
|---|---|---|---|---|
| 5,711,554 | A * | 1/1998 | Brown | E05B 65/0014 292/17 |
| 6,427,805 | B1 * | 8/2002 | Gibson | E06C 1/387 182/165 |
| 6,550,579 | B2 * | 4/2003 | Gibson | E06C 1/387 182/161 |
| 7,686,353 | B2 * | 3/2010 | Lewis | E05B 17/0004 16/82 |
| 7,849,967 | B2 * | 12/2010 | Gibson | E06C 1/393 182/165 |
| 8,726,473 | B2 * | 5/2014 | Dole | B60R 13/0206 24/297 |
| 8,888,148 | B2 * | 11/2014 | Hsu | E05C 19/06 292/303 |
| 10,100,575 | B1 * | 10/2018 | Neubauer | E06C 1/38 |
| 2006/0124397 | A1 * | 6/2006 | Vosbein-Jensen | E06C 1/20 182/165 |
| 2006/0266586 | A1 * | 11/2006 | Troiani | E06C 1/20 182/169 |
| 2015/0233181 | A1 * | 8/2015 | Walsh | E06C 7/50 403/27 |
| 2017/0130529 | A1 * | 5/2017 | Tamez Reyes | E06C 1/18 |
| 2018/0094485 | A1 * | 4/2018 | Carrera | E06C 7/06 |

* cited by examiner

LADDER WITH PINCH FLEX LATCH, AND METHOD

CROSS-REFERENCE TO RELATED APPLICATIONS

This is a non-provisional of U.S. provisional patent application Ser. No. 62/520,965 filed Jun. 16, 2017, and is a continuation-in-part of U.S. patent application Ser. No. 15/375,996 filed Dec. 12, 2016, incorporated by reference herein.

FIELD OF THE INVENTION

The present invention pertains to a one-piece latch attached to a first object that engages with a catch attached to a second object to latch the first object to the second object. (As used herein, references to the "present invention" or "invention" relate to exemplary embodiments and not necessarily to every embodiment encompassed by the appended claims.) More specifically, the present invention pertains to a one-piece latch attached to a first object that engages with a catch attached to a second object to latch the first object to the second object where the latch has a cam portion against which the second object pushes against as it moves toward the first object, and after clearing the cam portion a hook portion of the latch automatically engages with the catch to latch the first object with the second object.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

In a multitude of instances where a first object and a second object removably attach to each other, there is a need to securely hold the first object and second object together in certain positions. For instance, when a step ladder is moved into an open position, it is desired to latch in place a front portion or platform to a rear portion of the ladder, so the ladder can be maintained in an open or use position and a user's hand safely climb the stepladder without concern that the stepladder will collapse. Simple latches are manually moved by a user into place when the first object and second object are in a desired position. More complex latches have some type of biasing force, such as a spring, incorporated into them so that the latch automatically latches the first object and second object together without the user having to manually move the latch whatsoever. The more complex latches with more components and weight because of the presence of more components, an increase the likelihood of failure in the sense that there are more components to fail. For certain applications, it would be desirable to have a latch which automatically biases to latch a first object and a second object when they are brought together.

BRIEF SUMMARY OF THE INVENTION

The present invention pertains to a latch for latching a first object with a second object. The latch comprises a catch attached to the first object. The latch comprises a hook portion having a hook which engages with the catch attached to the first object that the latch holds in place. The latch comprises a base portion that is fixed to a rigid surface of the second object. The ladder comprises a pinch flex portion connected to the base portion and the hook portion. When the pinch flex portion is compressed or pinch flexed downward to the base portion, the hook portion moves off of the first object, thus releasing the first object to move away from the second object. When the first object is to be held or latched to the second object, the first object is moved against a cam portion of the hook portion, pushing the hook portion back away from the first object until the first object clears the hook of the hook portion, whereupon the hook portion no longer being restrained by the first object, under a force bias created in the pinch flex portion by the pinch flex portion being compressed, automatically moves back and catches or latches the first object to the second object without any spring or other component to create the force bias. The hook portion and base portion and pinch flex portion all together being one piece.

The present invention pertains to a method for latching a first object with a second object. The method comprises the steps of compressing a pinch flex portion of a latch downward toward a base portion of the latch that is fixed to a rigid surface of the second object causing a hook portion of the latch to move off of a catch attached to the first object, thus releasing the first object to move away from the second object. The pinch flex portion connected to the base portion and the hook portion. There is the step of moving the first object away from the second object. There is the step of moving the first object against a cam portion of the hook portion, which pushes the hook portion back away from the first object until the first object clears the hook of the hook portion, whereupon the hook portion no longer being restrained by the first object, under a force bias created in the pinch flex portion by the pinch flex portion being compressed, automatically moves back and catches or latches the first object to the second object without any spring or other component to create the force bias. The hook portion and base portion and pinch flex portion all together being one piece.

The present invention pertains to a ladder. The ladder comprises a front rail of a front section. The ladder comprises a rear rail of a rear section. The ladder comprises a step attached to the front rail. The ladder comprises a latch attached to the rear section and positioned on the rear section so when the ladder is in a folded position, the latch latches with the step. The latch comprises a hook portion having a hook which engages with the step attached to the front rail that the latch holds in place. The latch comprises a base portion that is fixed to a rigid surface of the rear rail. The latch comprises a pinch flex portion connected to the base portion and the hook portion. When the pinch flex portion is compressed or pinch flexed downward to the base portion, the hook portion moves off of the step attached to the front rail, thus releasing the front rail to move away from the rear rail. When the front section is to be held or latched to the rear section, the step of the front section is moved against a cam portion of the hook portion, pushing the hook portion back away from the step of the front rail until the front rail clears the hook of the hook portion, whereupon the hook portion no longer being restrained by the step of the front section, under a force bias created in the pinch flex portion by the pinch flex portion being compressed, automatically moves back and catches or latches the front section to the rear section without any spring or other component to create the force bias. The latch having the hook portion and base portion and pinch flex portion all together being one piece.

The present invention pertains to a method for latching a front section of a ladder with a rear section of the ladder. The method comprises the steps of compressing a pinch flex portion of a latch downward toward a base portion of the latch that is fixed to a rigid surface of the rear section causing a hook portion of the latch to move off of a step attached to a front rail of the front section, thus releasing the front section to move away from the rear section. The pinch flex portion is connected to the base portion and the hook portion. There is the step of moving the front section away from the rear section. There is the step of moving the step of the front section, against a cam portion of the hook portion, which pushes the hook portion back away from the step of the front section until the step of the front section clears the hook of the hook portion, whereupon the hook portion no longer being restrained by the step of the front section, under a force bias created in the pinch flex portion by the pinch flex portion being compressed by the step, automatically moves back and catches or latches the step and thus the front section to the rear section without any spring or other component to create the force bias. The latch having the hook portion and base portion and pinch flex portion all together being one piece.

The present invention pertains to a ladder. The ladder comprises a front section having a front right rail and a front left rail. The ladder comprises a rear section having a rear right rail and a rear left rail. The ladder comprises a step attached to the front right rail and front left rail. The ladder comprises a cross bar attached to the rear right rail and the rear left rail. The ladder comprises a latch attached to the cross bar and positioned on the cross bar so when the ladder is in a folded position where the front section is alongside and in parallel with the rear section, the latch latches with the step. The latch comprises a hook portion having a hook which engages with the step attached to the front right rail and front left rail that the latch holds in place. The latch comprises a base portion that is fixed to a rigid surface of the cross bar. The latch comprises a pinch flex portion connected to the base portion and the hook portion. When the pinch flex portion is compressed or pinch flexed downward to the base portion, the hook portion moves off of the step, thus releasing the front section to move away from the rear section, When the front section is to be held or latched to the rear section, the step attached to the front section is moved against a cam portion of the hook portion, pushing the hook portion back away from the step until the front section clears the hook of the hook portion, whereupon the hook portion no longer being restrained by the step. Under a force bias created in the pinch flex portion by the pinch flex portion being compressed, automatically moves back and catches or latches the step and thus the front section to the rear section without any spring or other component to create the force bias. The latch is one piece.

The present invention pertains to a method for using a step ladder. The method comprises the steps of moving a pinch flex latch attached to a cross bar of a rear section of the stepladder so a cam surface of a cam portion of the pinch flex latch contacts a front edge of a striker attached to a step of a front section of the stepladder, which moves the cam portion aside so the cam portion clears the front edge of the striker and the hook of the pinch flex latch latches with the striker so the front section and rear section are latched together. There is the step of pressing on a pinch flex portion of the pinch flex latch to move the hook so the hook clears the striker. There is the step of moving the front and rear sections apart after the hook clears the striker.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
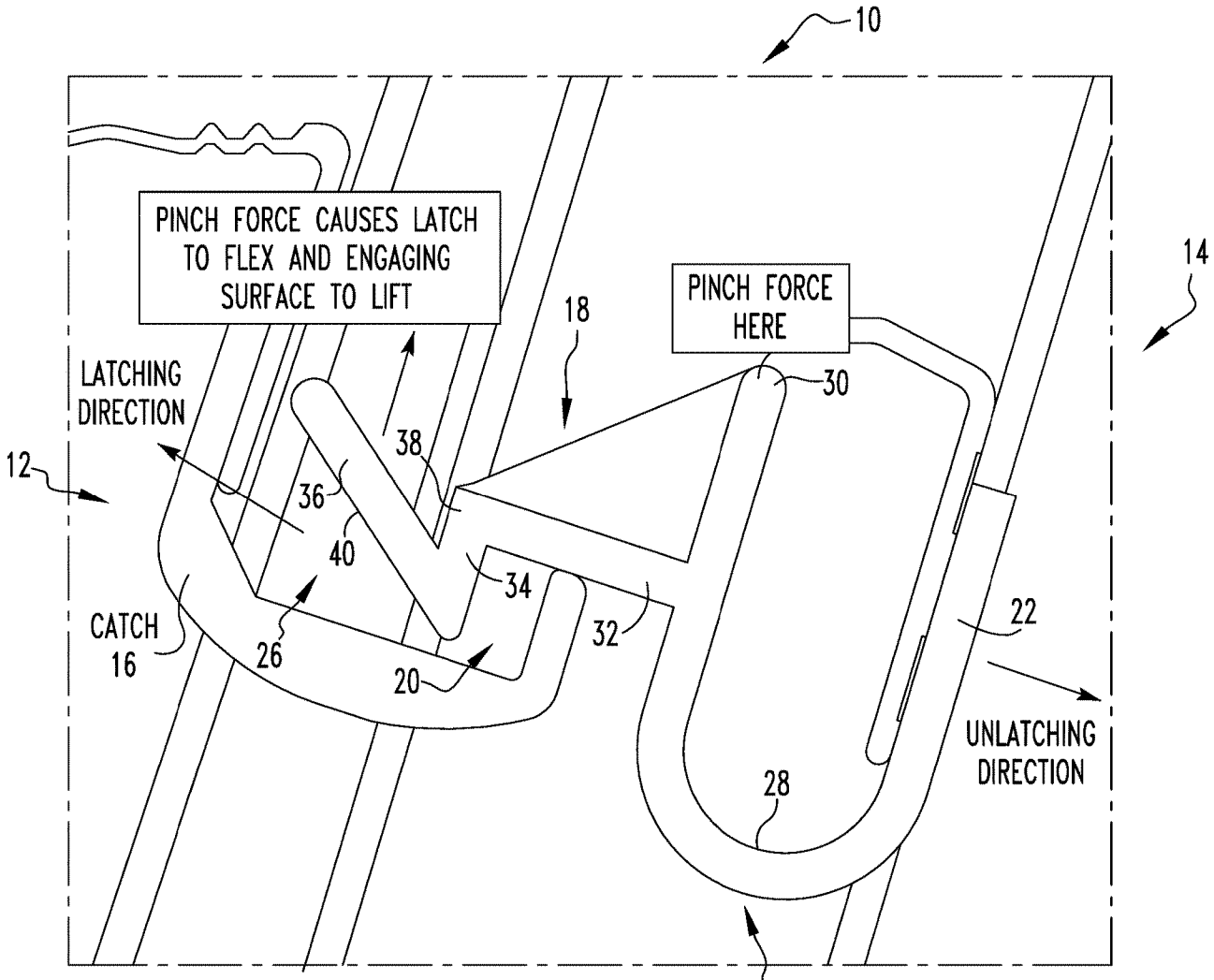
FIG. 1 is a representation of the latch of the present invention.

Referring now to the drawings wherein like reference numerals refer to similar or identical parts throughout the several views, and more specifically to FIG. 1 thereof, there is shown a latch 10 for latching a first object 12 with a second object 14. The latch 10 comprises a catch 16 attached to the first object 12. The latch 10 comprises a hook portion 18 having a hook 20 which engages with the catch 16 attached to the first object 12 that the latch 10 holds in place. The latch 10 comprises a base portion 22 that is fixed to a rigid surface of the second object 14. The ladder 48 comprises a pinch flex portion 24 connected to the base portion 22 and the hook portion 18. When the pinch flex portion 24 is compressed or pinch flexed downward to the base portion 22, the hook portion 18 moves off of the first object 12, thus releasing the first object 12 to move away from the second object 14. When the first object 12 is to be held or latched to the second object 14, the first object 12 is moved against a cam portion 26 of the hook portion 18, pushing the hook portion 18 back away from the first object 12 until the first object 12 clears the hook 20 of the hook portion 18, whereupon the hook portion 18 no longer being restrained by the first object 12, under a force bias created in the pinch flex portion 24 by the pinch flex portion 24 being compressed, automatically moves back and catches or latches the first object 12 to the second object 14 without any spring or other component to create the force bias. The hook portion 18 and base portion 22 and pinch flex portion 24 all together being one continuous piece. The material for the latch may be a bendable plastic, such as Delrin 127 UV NC010, which is an acetyl resin.

The pinch flex portion 24 may have a loop 28 and a free end 30 that together form a U shape with the base portion 22. The free end 30 extending from the loop 28 which is able to move up and down and essentially in parallel with the base portion 22. When a compressive force is applied to the free end 30, the free end 30 moves down towards the base portion 22 pivoting at the loop 28. The hook portion 18 may extend outward away from the base portion 22 essentially perpendicularly from the free end 30.

The hook portion 18 may include a first element 32 attached to and extending essentially perpendicularly from the free end 30 outward away from the free end 30, a second element 34 attached at a connection point 38 to the first element 32 extending essentially perpendicularly from the first element 32 and in parallel with the free end 30, and a third element 36 attached to the second element 34 extending outward at an acute angle away from the second element 34 and back toward the connection point 38 between the first element 32 in the second element 34 to define a slope 40. The third element 36 may be the cam portion 26 against which the catch 16 pushes back as the first object 12 is moved toward the second object 14 until the catch 16 moves down the slope 40 and clears the second element 34, whereupon the second element 34 moves back over the catch 16, the second element 34 and first element 32 forming the hook 20.

Figure 4:
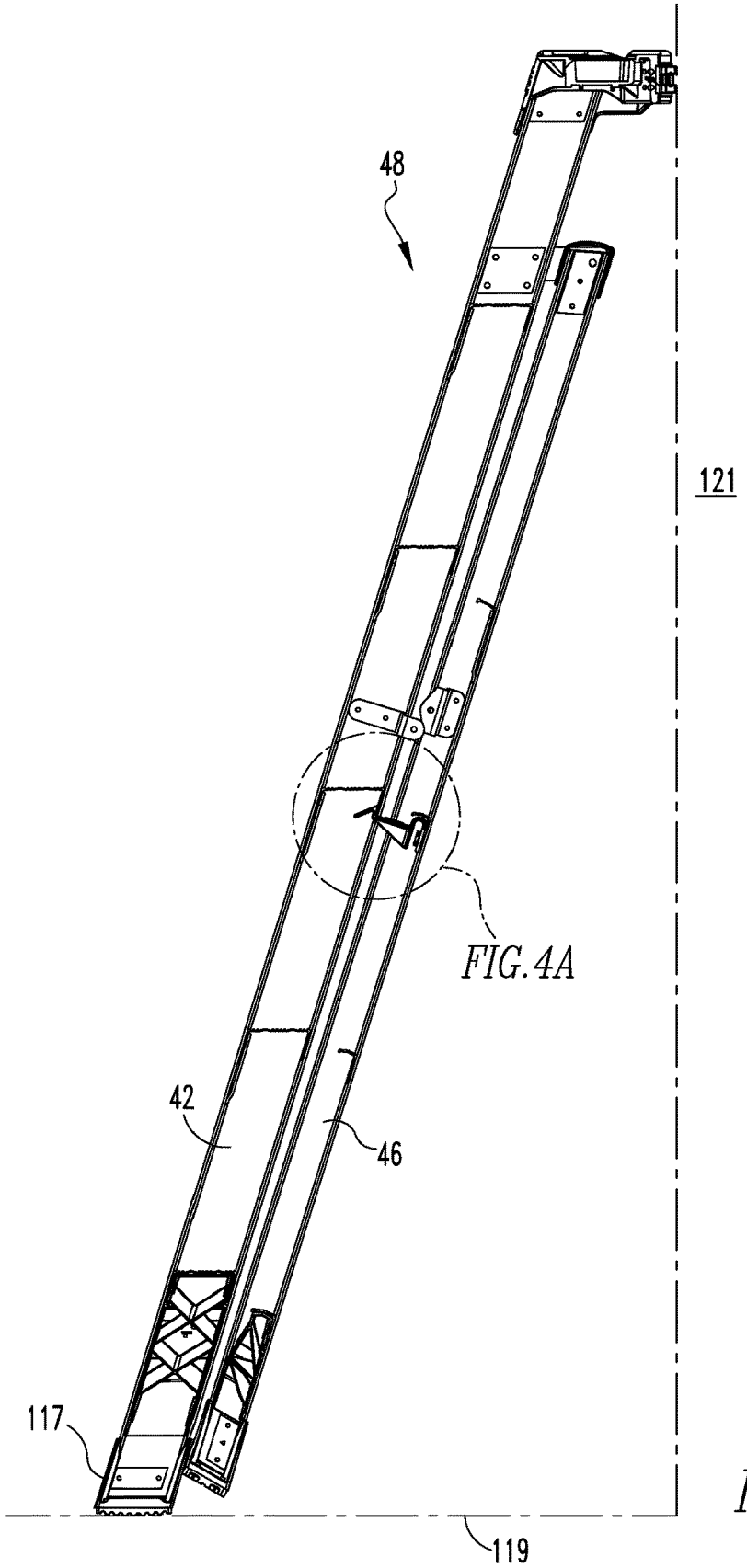
FIG. 4 shows a side view of a ladder of the present invention in a folded position leaning against a wall.
Figure 4A:
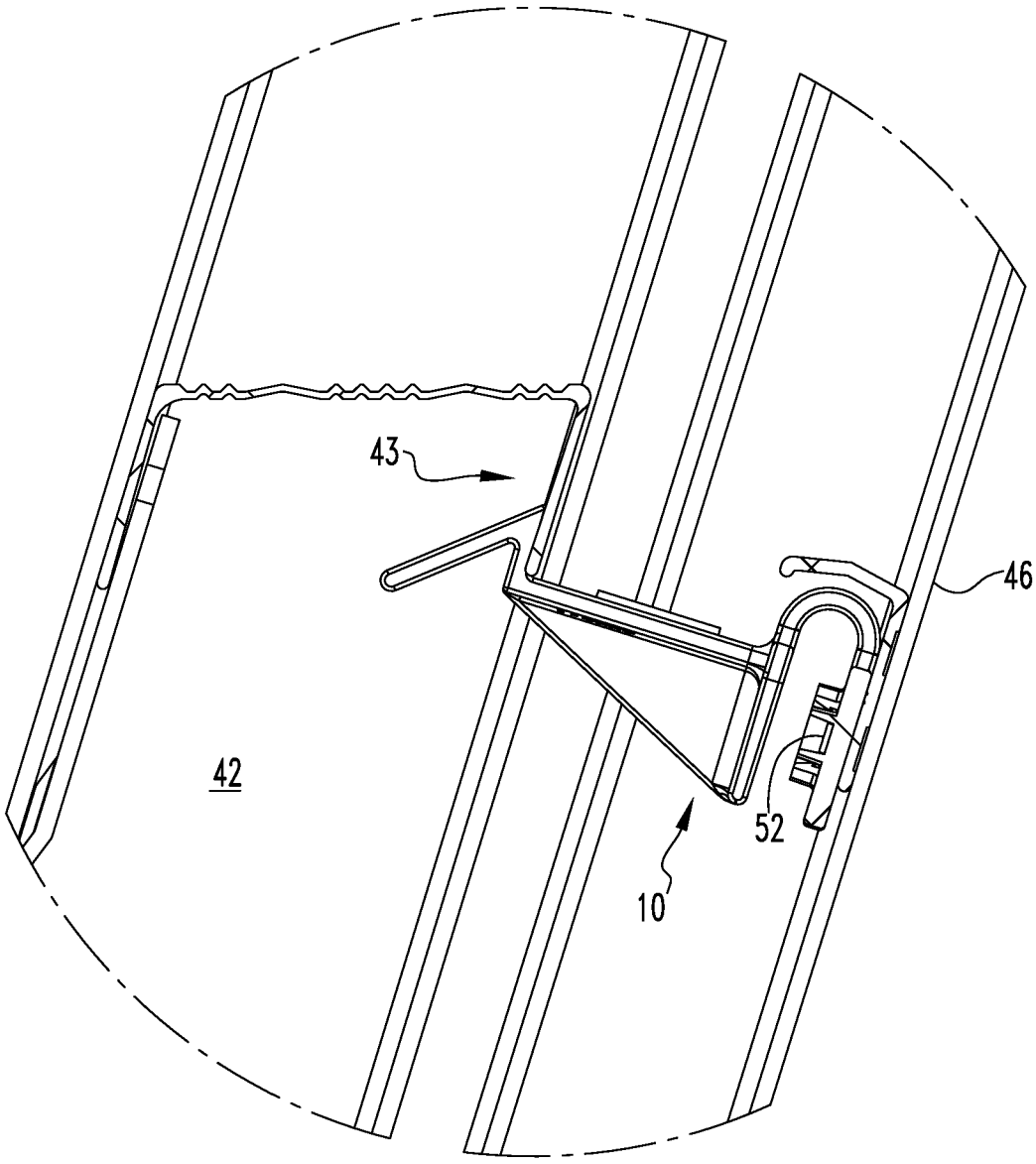
FIG. 4A is an exploded view of the latch engaged with the step of the ladder of FIG. 4.
Figure 5:
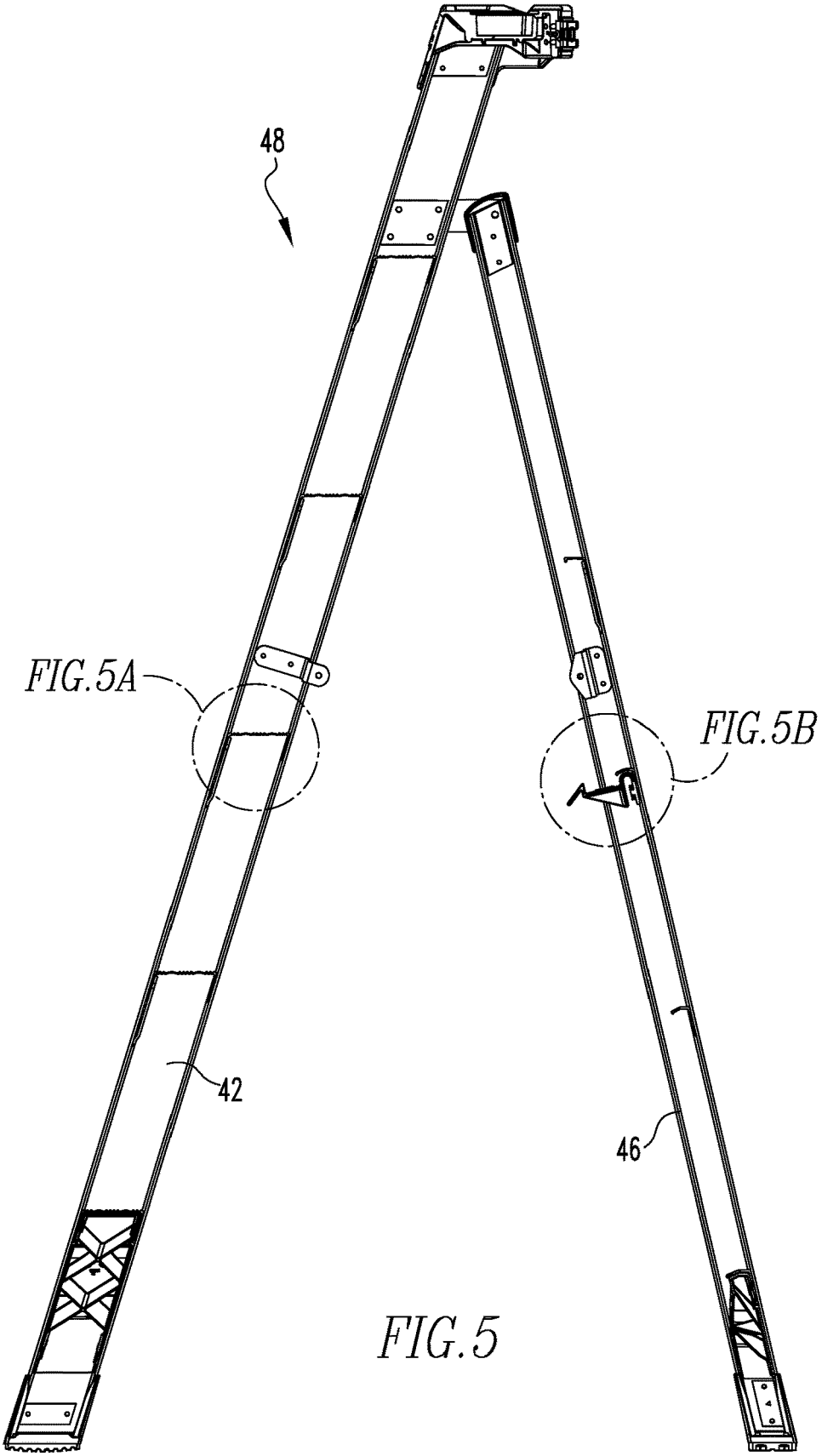
FIG. 5 shows a side view of the ladder in the open position.
Figure 5A:
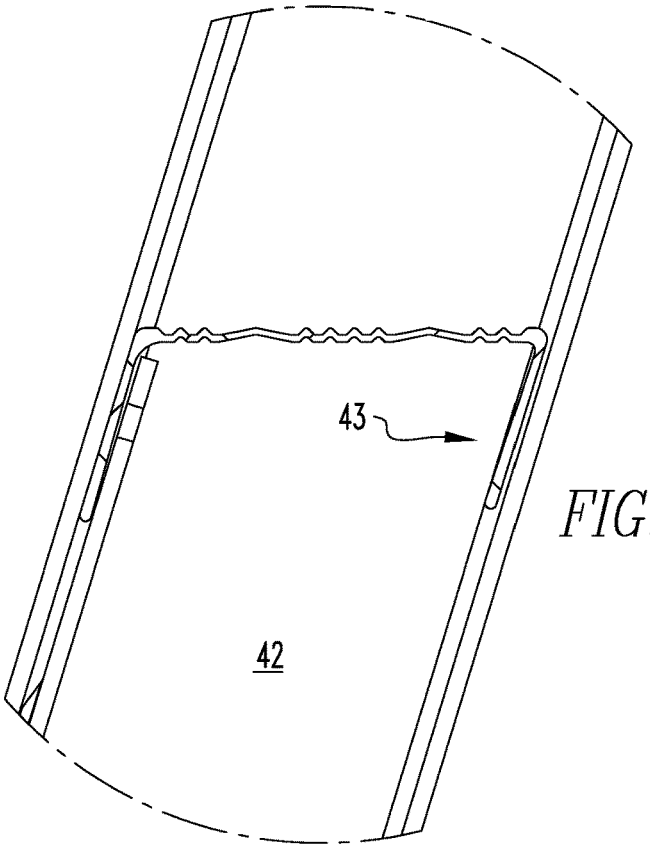
FIG. 5A is an exploded view of a step of the ladder of FIG. 5.
Figure 5B:
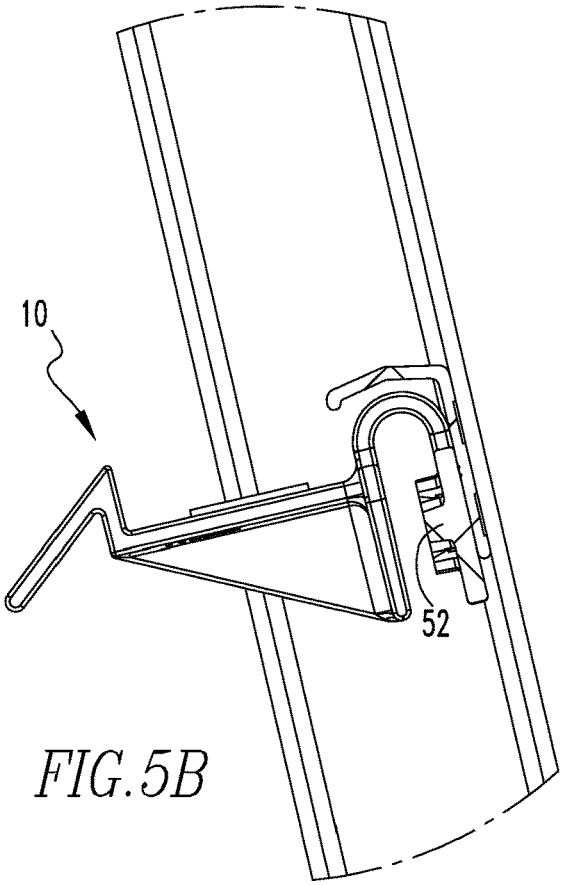
FIG. 5B is an exploded view of the latch attached to the ladder of FIG. 5.
Figure 6:
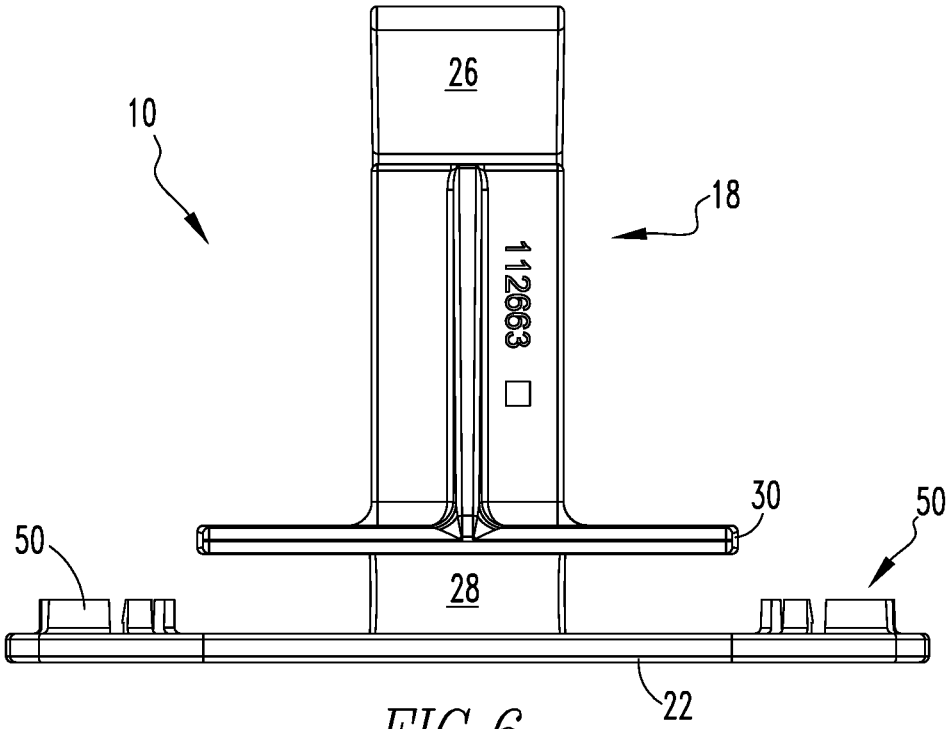
FIG. 6 shows a front view of the latch.
Figure 7:
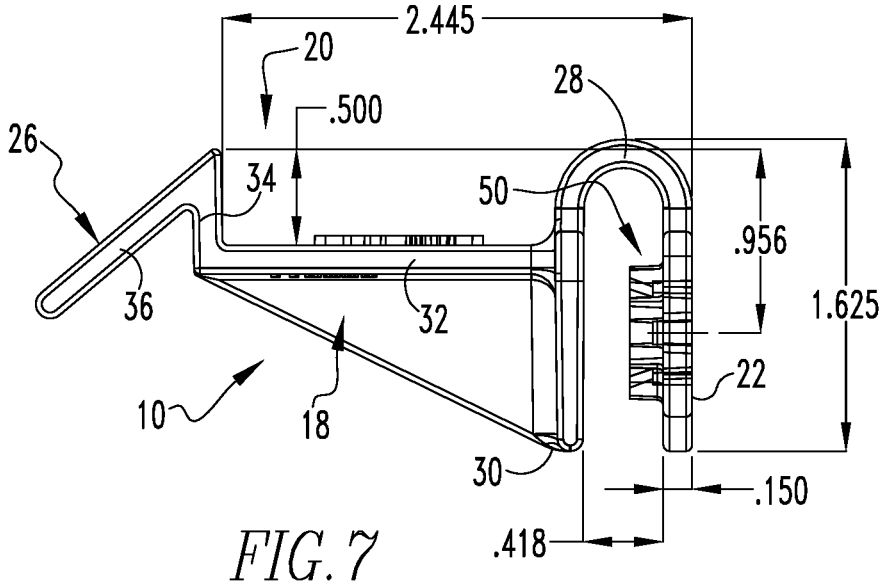
FIG. 7 shows a side view of the latch.
Figure 8:
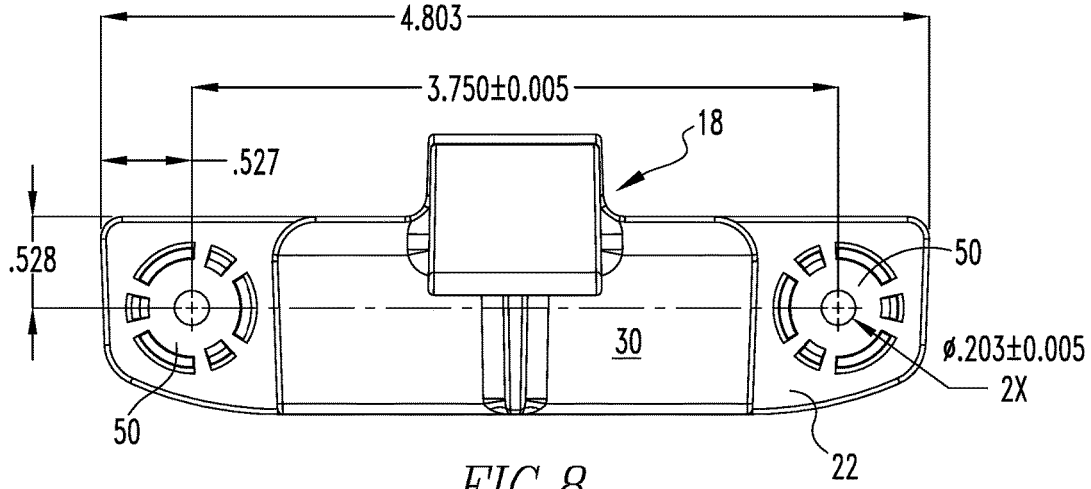
FIG. 8 shows an overhead view of the latch.
Figure 9:
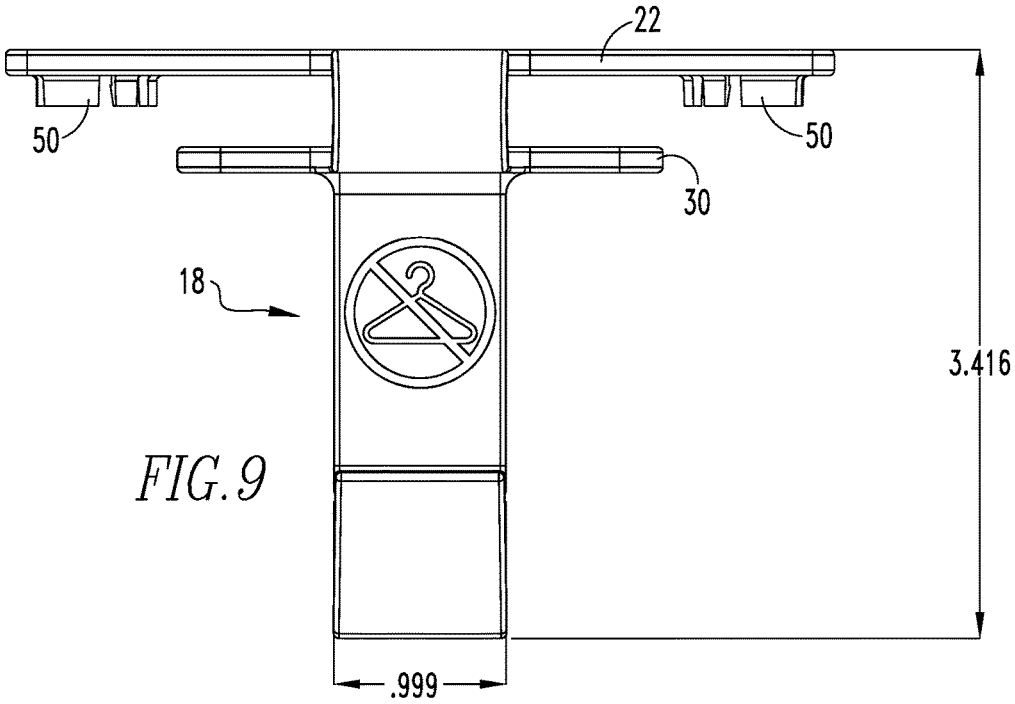
FIG. 9 shows a rear view of the latch.
Figure 10:
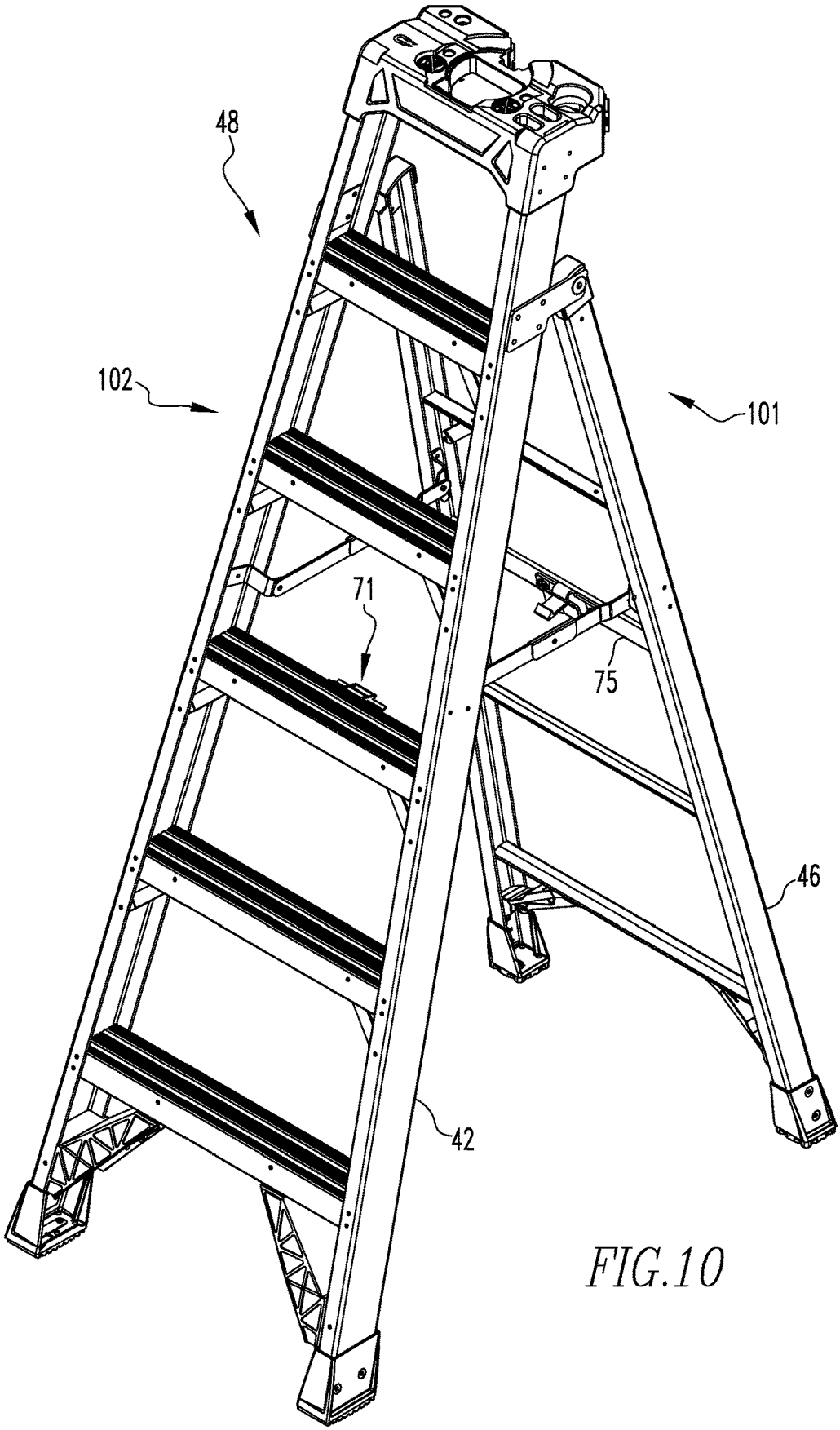
FIG. 10 is a perspective view of a ladder with a striker to receive the pinch latch.
Figure 11:
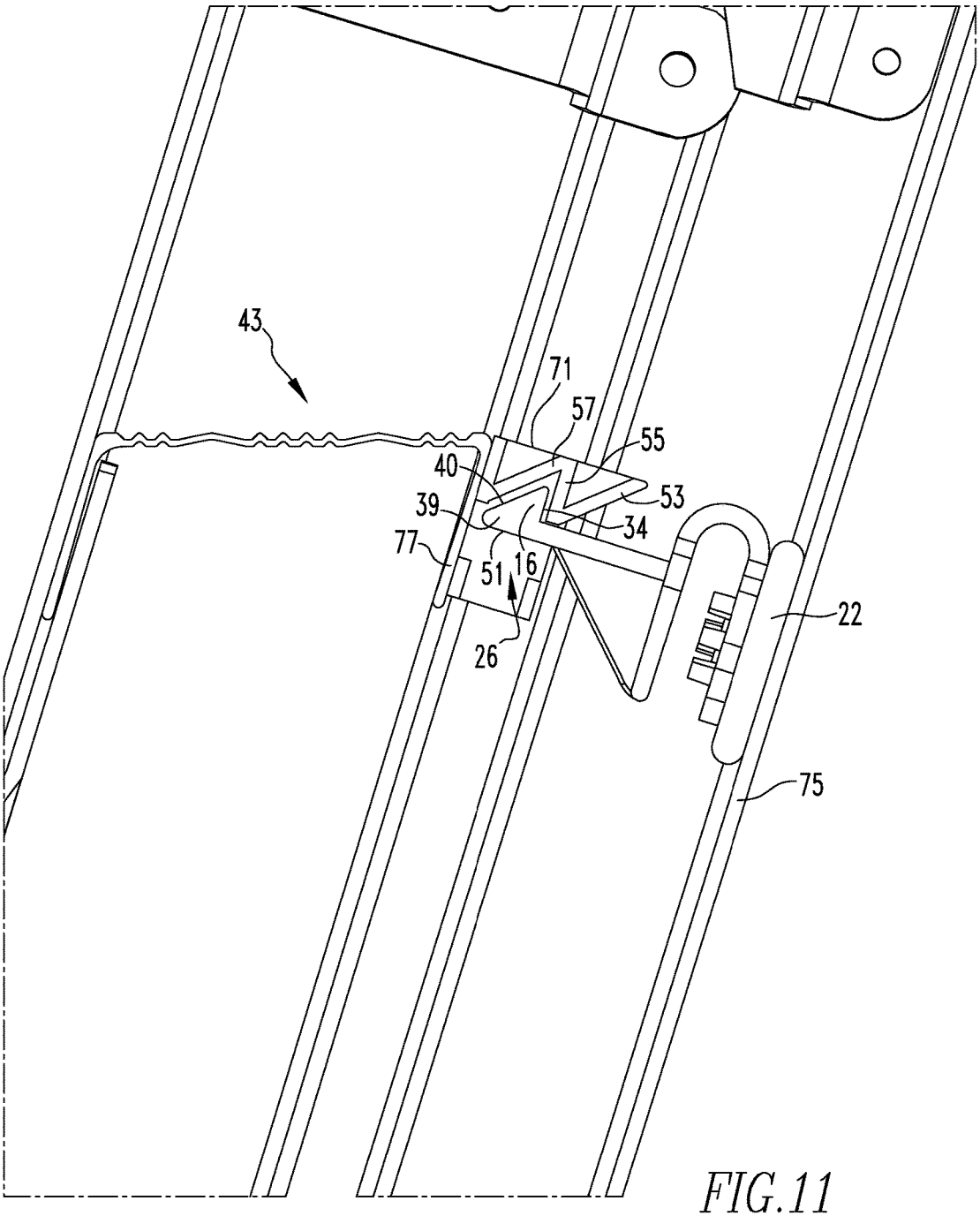
FIG. 11 is a cutaway cross-sectional view of the pinch latch engaged with the striker.
Figure 12:
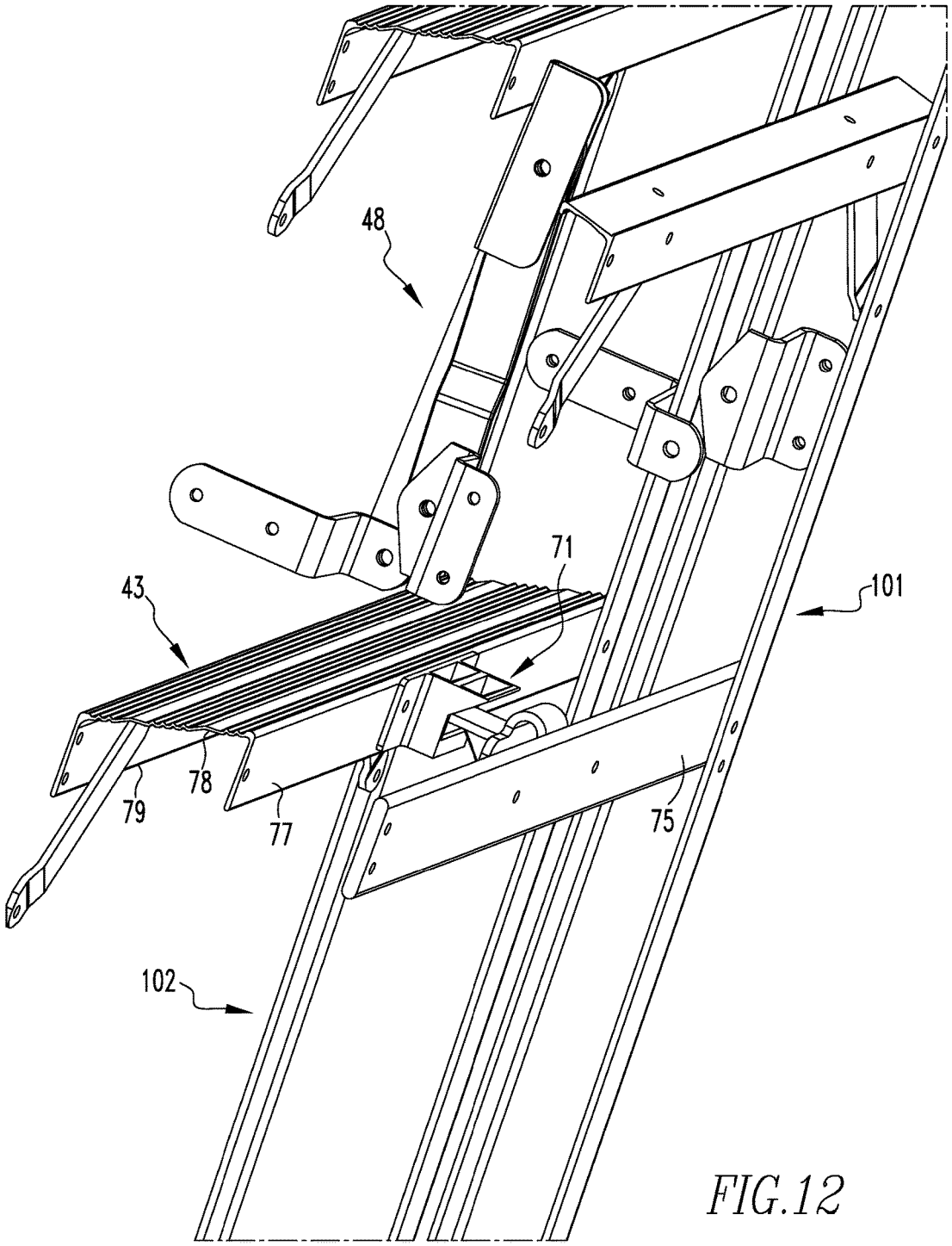
FIG. 12 is a perspective view of the pinch latch engaged with the striker.
Figure 13:
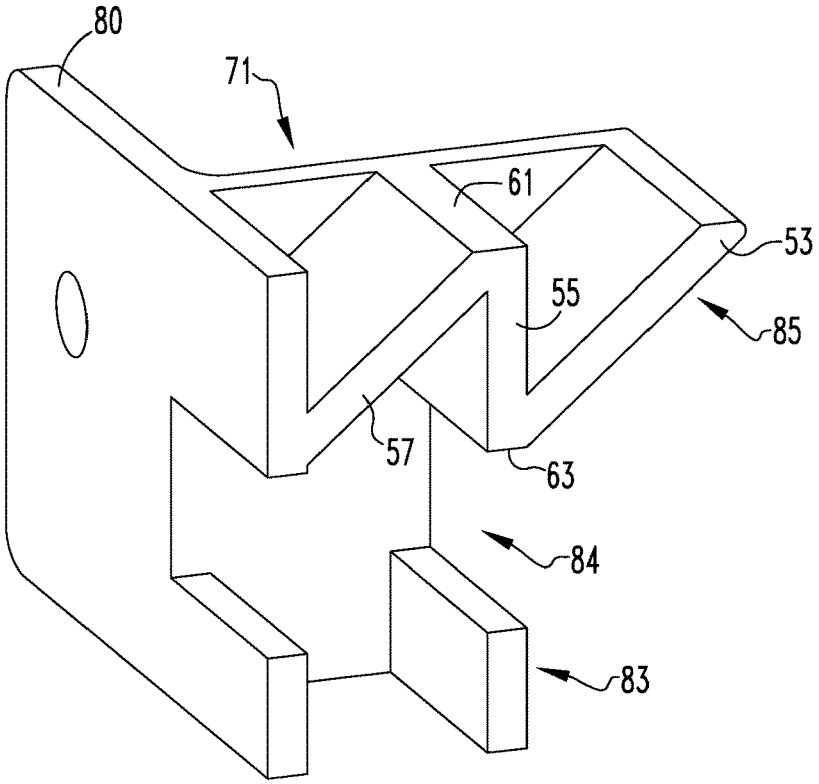
FIG. 13 is a cross-sectional view of the striker.
Figure 14:
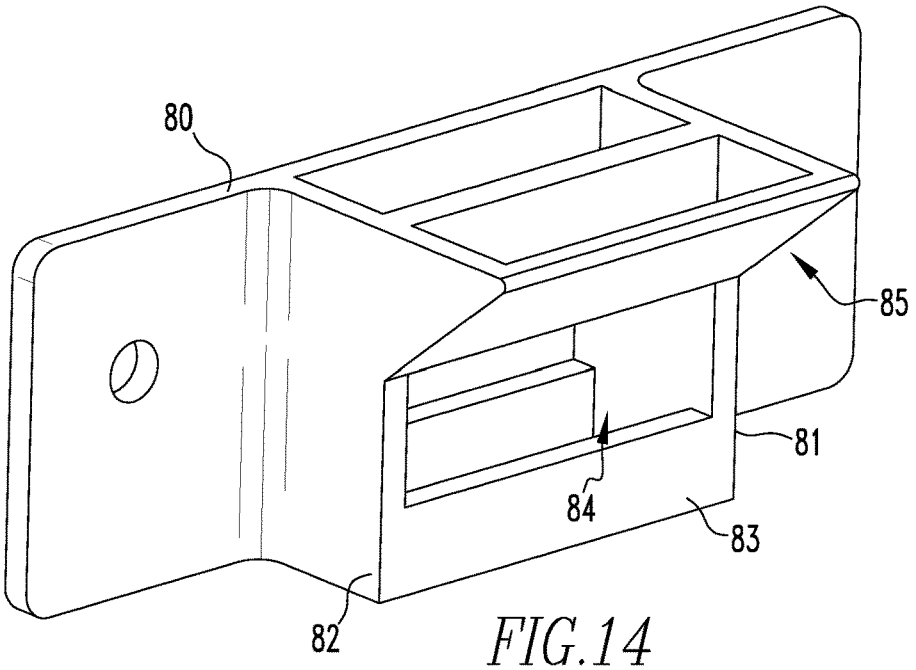
FIG. 14 is a front perspective view of the striker.

The first object may be a step 43 attached to a front rail 42 of a ladder 48, as shown in FIGS. 4 and 5, and the second object may be a cross bar 75 attached to the rear rail 46 of the ladder 48. FIG. 4 shows the ladder 48 in the folded position with the latch 10 engaged with the catch 16, which in this embodiment is a step 43 attached to the inside of the front rail 42. When the ladder 48 is in the folded position, the latch 10 on the cross bar 75 attached to the rear rail is aligned with the step 43 attached to the front rail 42 to latch with the step 43. FIG. 5 shows a ladder 48 in the open position for use.

In regard to FIG. 4, the stepladder 48 is in the folded position, where the front section 102 and the rear section 101 are latched together with the latch 10 engaged with the step 43, and the stepladder 48 is leaning against a wall 121 with the foot 117 of each rail flat or flush with the floor 119 so the ladder 48 does not slide away from the object. In this leaning position with the ladder 48 in the folded position, a user can climb the ladder 48. In the folded position, the rear section 101 latched to the front section 102, is not in contact with the floor 119, so the stepladder 48 essentially acts as an extension ladder that is leaned against a wall 121. The ladder 48 in the folded position can also lean against other structures, besides it wall 21, such as planks or corners or poles. See U.S. patent application Ser. No. 15/802,949, filed contemporaneously with this patent application, incorporated by reference herein. With the rear section 101 latched to the front section 102, the rear section is securely held in place and does not move about or hang loosely, which could put the ladder 48 in an unstable position while it is leaning against the wall 121 and put the user in a dangerous situation when the user is standing on steps of the ladder 48.

The present invention pertains to a method for latching a first object 12 with a second object 14. The method comprises the steps of compressing a pinch flex portion 24 of a latch 10 downward toward a base portion 22 of the latch 10 that is fixed to a rigid surface of the second object 14 causing a hook portion 18 of the latch 10 to move off of a catch 16 attached to the first object 12, thus releasing the first object 12 to move away from the second object 14. The pinch flex portion 24 connected to the base portion 22 and the hook portion 18. There is the step of moving the first object 12 away from the second object 14. There is the step of moving the first object 12 against a cam portion 26 of the hook portion 18, which pushes the hook portion 18 back away from the first object 12 until the first object 12 clears the hook 20 of the hook portion 18, whereupon the hook portion 18 no longer being restrained by the first object 12, under a force bias created in the pinch flex portion 24 by the pinch flex portion 24 being compressed, automatically moves back and catches or latches the first object 12 to the second object 14 without any spring or other component to create the force bias. The hook portion 18 and base portion 22 and pinch flex portion 24 all together being one continuous piece.

The present invention pertains to a ladder 48, as shown in FIGS. 4 and 5. The ladder 48 comprises a front rail 42. The ladder 48 comprises a rear rail 46. The ladder 48 comprises a step 43 attached to the front rail 42. The ladder 48 comprises a latch 10 attached to a cross bar 75 attached to the rear rail 46 and positioned on the cross bar 75 so when the ladder 48 is in a folded position, the latch 10 latches with the step 43. The latch 10 comprises a hook portion 18 having a hook 20 which engages with the step 43 attached to the front rail 42 that the latch 10 holds in place. The latch 10 comprises a base portion 22 that is fixed to a rigid surface of the rear rail 46. The latch 10 comprises a pinch flex portion 24 connected to the base portion 22 and the hook portion 18. When the pinch flex portion 24 is compressed or pinch flexed downward to the base portion 22, the hook portion 18 moves off of the step 43 of the front rail 42, thus releasing the front rail 42 to move away from the rear rail 46. When the front rail 42 is to be held or latched to the rear rail 46, the bottom of the rear flange 77 of the step 43 attached to the front rail 42 is moved against a cam portion 26 of the hook portion 18, pushing the hook portion 18 back away from the rear flange 77 of the step 43 attached to the front rail 42 until the rear flange 77 of the step 43 clears the hook 20 of the hook portion 18, whereupon the hook portion 18 no longer being restrained by the step 43 attached to the front rail 42, under a force bias created in the pinch flex portion 24 by the pinch flex portion 24 being compressed, automatically moves back and catches or latches the rear flange 77 of the step 43 and thus the front rail 42 to the rear rail 46 without any spring or other component to create the force bias. The hook portion 18 and base portion 22 and pinch flex portion 24 all together being one continuous piece.

Figure 2:
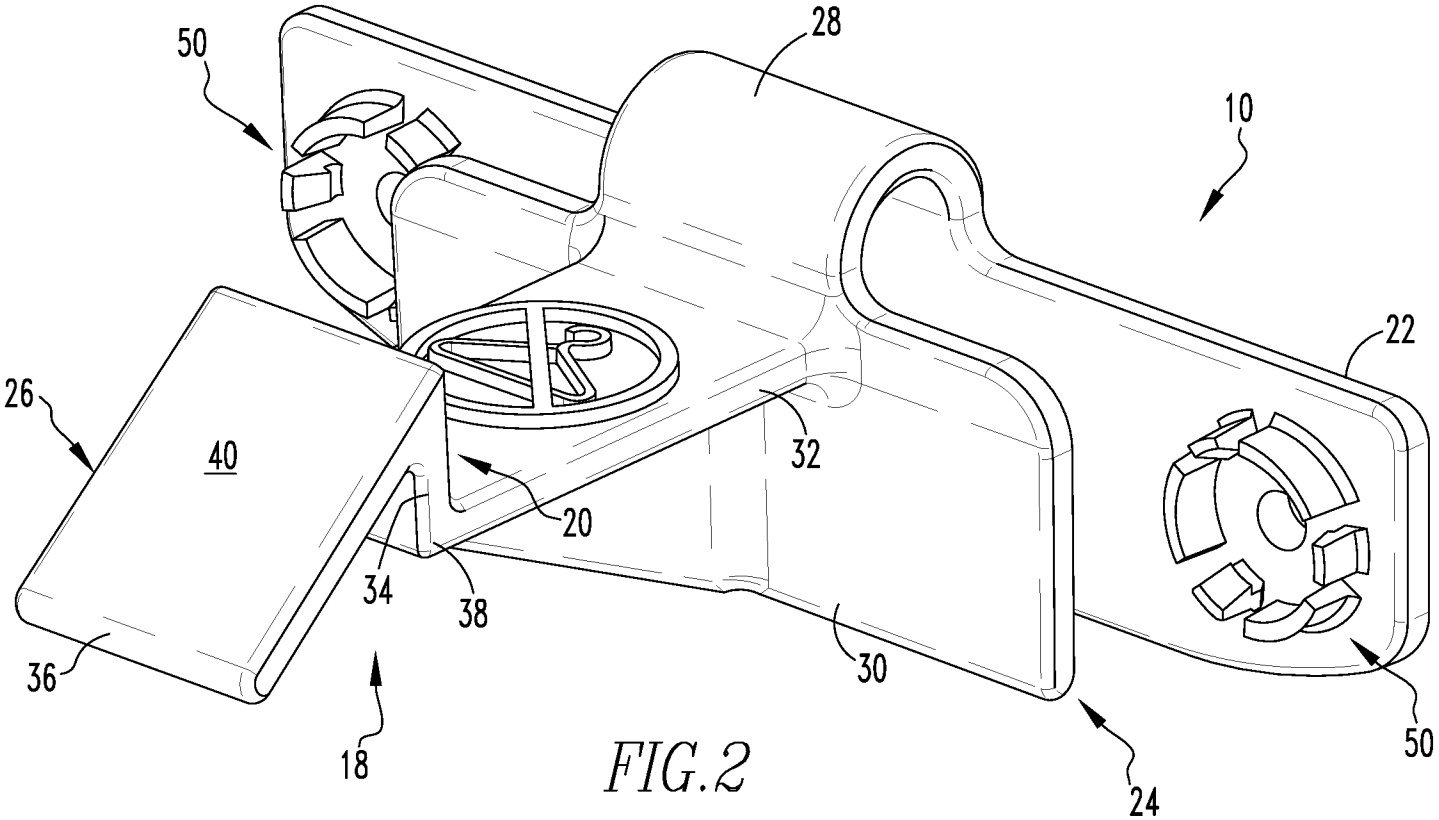
FIG. 2 shows a perspective view of the latch.
Figure 3:
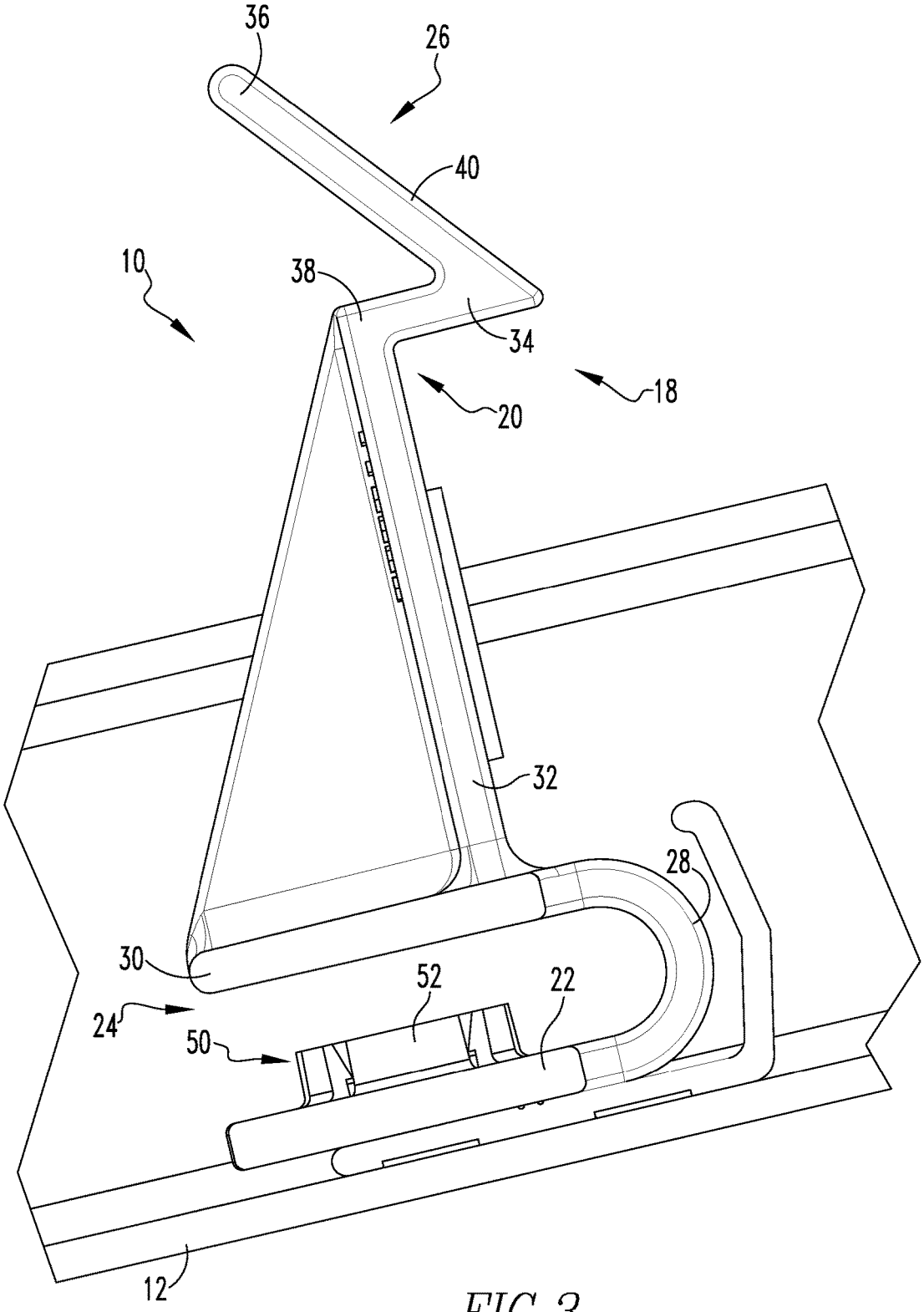
FIG. 3 shows a side view of the latch attached to a rear rail of a ladder.

The base portion 22 may have a rivet received portion 50, as shown in FIG. 2, on either end of the base portion 22. A rivet 52 extending through the base portion 22 at each receive portion and the rear rail 46 fixes the latch 10 to the rear rail 46, as shown in FIGS. 3, 4 and 5.

The present invention pertains to a method for latching a front rail 42 of a ladder 48 with a rear rail 46 of the ladder 48. The method comprises the steps of compressing a pinch flex portion 24 of a latch 10 downward toward a base portion 22 of the latch 10 that is fixed to a rigid surface of a cross bar 75 attached to the rear rail 46 causing a hook portion 18 of the latch 10 to move off of a step 43 attached to the front rail 42, thus releasing the front rail 42 to move away from the rear rail 46. The pinch flex portion 24 is connected to the base portion 22 and the hook portion 18. There is the step of moving the front rail 42 away from the rear rail 46. There is the step of moving the step 43 of the front rail 42 against a cam portion 26 of the hook portion 18, which pushes the hook portion 18 back away from the step 43 attached to the front rail 42 until the step 43 clears the hook 20 of the hook portion 18, whereupon the hook portion 18 no longer being restrained by the step 43 attached to the front rail 42, under a force bias created in the pinch flex portion 24 by the pinch flex portion 24 being compressed by the step 43, automatically moves back and catches or latches the step 43 and thus the front rail 42 to the rear rail 46 without any spring or other component to create the force bias. The latch 10 is one piece.

FIGS. 6-9 show different views of the latch 10 as well as dimensions for a preferred embodiment. The thickness of the base portion 22, loop 28, free end 30, first element 32, second element 34 and third element 36 can be between 0.1 inches and 0.4 inches, and preferably 0.15 inches. The height of the latch 10 can be between 3 inches and 6 inches and is preferably about 3.4 inches. The width of the hook portion 18 can be between 0.75 inches and 3 inches and is preferably about 1 inch. The length of the base portion 22 can be between 3 inches and 7 inches and is preferably about 4.8 inches. The width of the base portion 22 can be between 0.75 inches and 3 inches and is preferably about 1 inch wide. The width of the free end 30 is about the same with as the base portion and the length of the free end 30 is between 2 inches and 6 inches preferably about 3 inches. The length of the free end should be such that the rivet receive portions 50 clear the free end 30. The dimensions of the latch 10 may be varied as the requirements dictate with for instance the thickness changing and the other components changing in the corresponding amount.

The present invention pertains to a ladder 48. The ladder 48 comprises a front section 102 having a front right rail and a front left rail. The ladder 48 comprises a rear section 101 having a rear right rail and a rear left rail. The ladder 48 comprises a step 43 attached to the front right rail and front left rail. The ladder 48 comprises a cross bar 75 attached to the rear right rail and the rear left rail. The ladder 48 comprises a latch attached to the cross bar 75 and positioned on the cross bar 75 so when the ladder 48 is in a folded position where the front section 102 is alongside and in parallel with the rear section 101, the latch latches with the step 43. The latch comprises a hook portion 18 having a hook 20 which engages with the step 43 attached to the front right rail and front left rail that the latch holds in place. The latch comprises a base portion 22 that is fixed to a rigid surface of the cross bar 75. The latch comprises a pinch flex portion 24 connected to the base portion 22 and the hook portion 18. When the pinch flex portion 24 is compressed or pinch flexed downward to the base portion 22, the hook portion 18 moves off of the step 43, thus releasing the front section 102 to move away from the rear section 101, When the front section 102 is to be held or latched to the rear section 101, the step 43 attached to the front section 102 is moved against a cam portion 26 of the hook portion 18, pushing the hook portion 18 back away from the step 43 until the front section 102 clears the hook 20 of the hook portion 18, whereupon the hook portion 18 no longer being restrained by the step 43. Under a force bias created in the pinch flex portion 24 by the pinch flex portion 24 being compressed, automatically moves back and catches or latches the step 43 and thus the front section 102 to the rear section 101 without any spring or other component to create the force bias. The latch is one piece.

The present invention pertains to a method for using a step ladder 48. The method comprises the steps of moving a pinch flex latch attached to a cross bar 75 of a rear section 101 of the stepladder so a cam surface of a cam portion 26 of the pinch flex latch contacts a front edge of a striker 71 attached to a step 43 of a front section 102 of the stepladder, which moves the cam portion 26 aside so the cam portion 26 clears the front edge of the striker 71 and the hook 20 of the pinch flex latch latches with the striker 71 so the front section 102 and rear section 101 are latched together. There is the step of pressing on a pinch flex portion 24 of the pinch flex latch to move the hook 20 so the hook 20 clears the striker 71. There is the step of moving the front and rear sections 102, 101 apart after the hook 20 clears the striker 71.

Referring to FIGS. 10-14, in another embodiment, the base 22 is attached to a crossbar 75 that is a flat plate of a rear section 101 of a ladder 48. Preferably, a striker 71 is attached to the rear flange 77 of the step 43. The step 43 essentially has a C shaped cross-section having a roughly flat center portion 78 with the front flange 79 and rear flange 77 extending essentially perpendicularly down from the center portion 78 with the center portion 78 disposed between the front and rear flanges.

Figure 15:
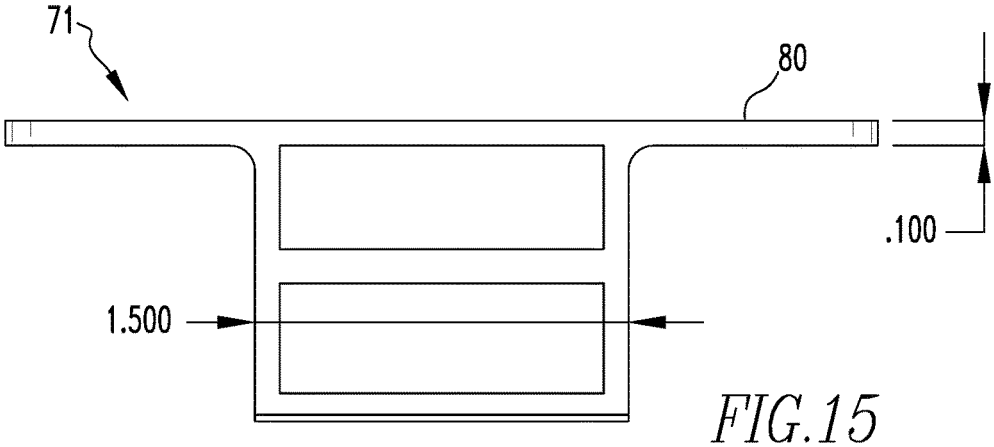
FIGS. 15-19 show overhead, front, underside, right, and cross-sectional cut away views of the striker.
Figure 16:
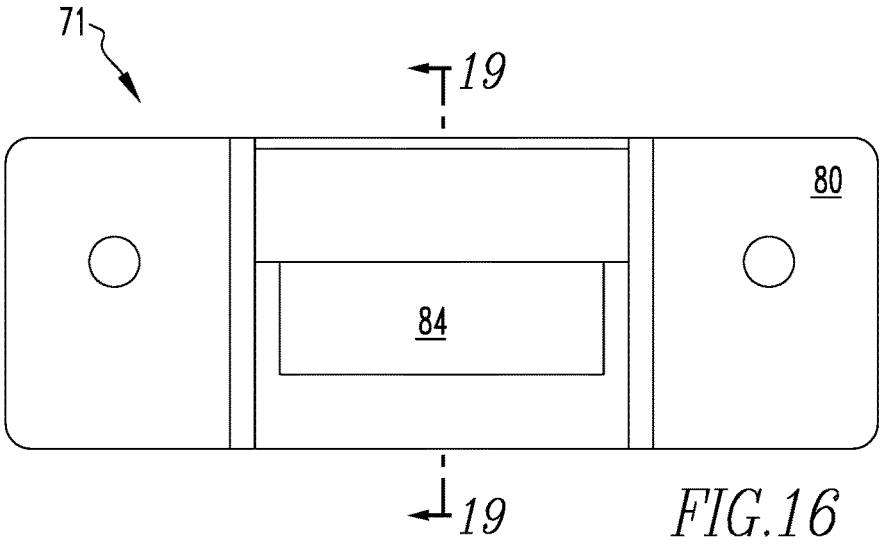
Figure 17:
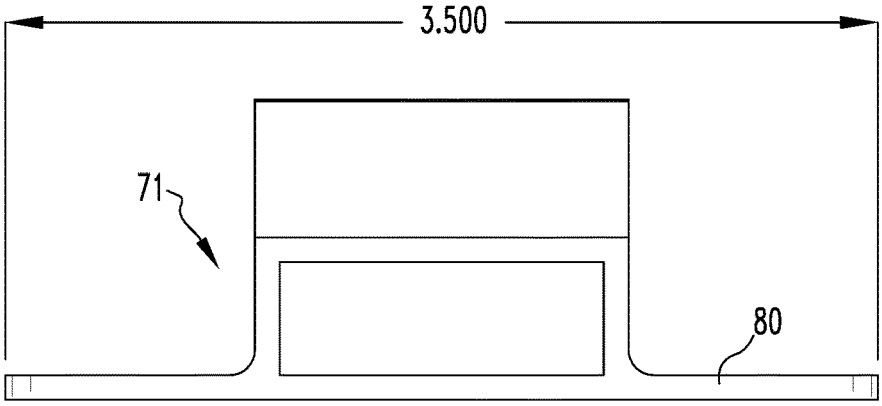
Figure 18:
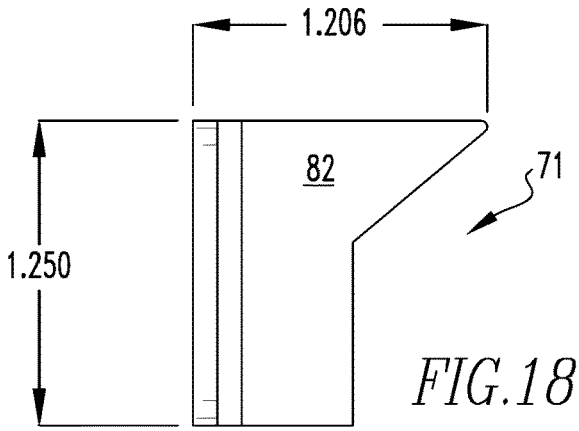
Figure 19:
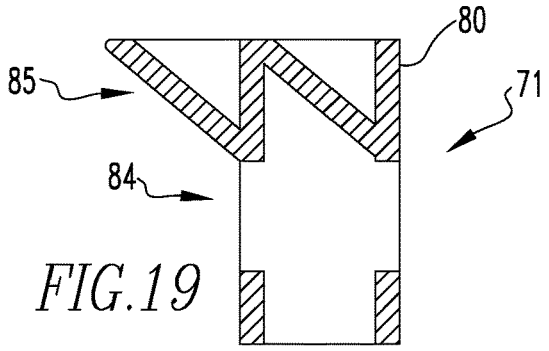

The striker 71 has a bottom 80 that is riveted to the rear flange 77. Extending from the bottom 80 is a right solid wall 81 and a left solid wall 82 in spaced relation from the right solid wall 81. There is a front wall 83 having a rectangular shaped window 84 and a Z shaped ceiling 85. The ceiling 85 and the front wall 83 are attached to the right and left walls. In this embodiment, the third element 36 of the latch 10 is solid with the slope 40 and a back surface 51 that extends from the first element 32, with the volume 39 between the back surface 51 and the slope 40 being solid. The alternative design of the latch 10 with the cam portion solid is shown in FIG. 15. FIGS. 15-19 show overhead, front, underside, right, left and perspective views of the striker.

In operation, as the rear section 101 of the ladder 48 is brought together with the front section 102, the slope 40 strikes a first slope portion 53 of the ceiling 85 of the striker 71. As the front and rear sections move closer together, the slope 40 and the first sloped surface 53 push against each other and move each other aside as the slope 40 slides along the first sloped surface 53 until the slope 40 clears the first sloped surface 53, whereupon the second element 34 of the hook 20 moves up alongside a straight stem 55 of the ceiling 85 of the striker 71, and engages with the stem 55. The stem 55 acts as a catch 16. The first sloped surface 53 extends at an acute angle upwards from the bottom 63 of the stem 55. The angle of the first sloped surface 53 and the slope 40 essentially correspond. Similarly, when the second element 34 is adjacent and in parallel with the stem 55, the slope 40 essentially lines with and conforms with a second sloped surface 57, whose angle is basically the same as the angle of the slope 40, so there is essentially no or little space between them when the ladder 48 is in the closed position. The second sloped surface 57 extends angularly downward from a top 61 of the stem 55 while the first sloped portion 53 extends angularly upwards from the bottom 63 of the stem 55.

Figure 20:
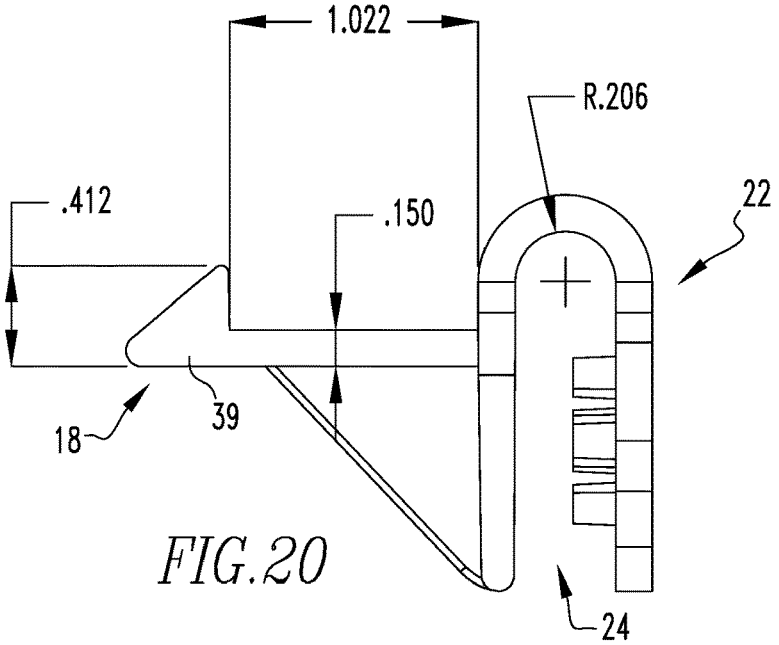
FIG. 20 shows a side view of an alternative embodiment of the latch.

By having the right and left solid walls preventing access to any space between them and the slope 40 and second sloped portion 57 being in conformance, any chance of a finger getting access to such space is eliminated; or an object accidentally catching on the cam portion 26 and accidentally opening and releasing the latch, resulting in the front section and rear section opening up, is eliminated. FIG. 20 shows the cam portion being solid of this embodiment. At least 30 lbs. of force is required to pull apart the front and rear sections and overcome the latch, if the latch is not pressed down under normal operation to allow separation of the front and rear sections.

In yet another alternative, the rear flange 77 may have a hole through which the hook portion of the latch fits in, with the top of the hole engaging with the hook portion, similar to the step bottom edge, as described above. For that matter, any edge of the hole could be used to latch the hook portion to, in which case the hook portion would be rotated to align with the desired edge of the hole chosen.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A ladder comprising:

a front section having a front right rail and a front left rail;

a rear section having a rear right rail and a rear left rail;

a step attached to the front right rail and front left rail; the step having a front flange and a rear flange and a center portion attached to and between the front flange and the rear flange; the rear flange further comprising a striker attached thereto;

a cross bar attached to the rear right rail and the rear left rail;

a latch attached to the cross bar and positioned on the cross bar so when the ladder is in a folded position where the front section is alongside and in parallel with the rear section, the latch latches with the striker on the rear flange of the step, the latch comprises:

a hook portion having a hook which engages with the striker to hold the latch in place;

a base portion that is fixed to the cross bar; and a pinch flex portion connected to the base portion and the hook portion, when the pinch flex portion is compressed or pinch flexed downward to the base portion, the hook portion moves off of the striker on the rear flange of the step thus releasing the front section to move away from the rear section, when the front section is to be held or latched to the rear section, the striker is moved against a cam portion of the hook portion, pushing the hook portion back away from the step until the front section clears the hook of the hook portion, whereupon the hook portion no longer being restrained by the striker, under a force bias created in the pinch flex portion by the pinch flex portion being compressed, automatically moves back and catches or latches the striker on the step and thus the front section to the rear section without any spring or other component to create the force bias, the latch is one piece.

2. The ladder of claim 1 wherein the striker having a window for receiving the hook portion, the hook portion engages with the striker when the front and rear sections are in the closed position to hold the front and rear sections together.

3. The ladder of claim 2 wherein the striker having a Z shaped roof with a first slope portion, a straight stem connected to the first slope portion, the first sloped portion angled inwards from a bottom of the stem, and a second sloped portion connected to the stem and extending down from a top of the stem.

4. The ladder of claim 3 wherein the first and second sloped portions each having an angle that essentially conforms to an angle of a slope of a cam portion of the hook portion of the latch.

5. The ladder of claim 4 wherein the striker is one piece.

* * * * *